US012595615B2

(12) United States Patent
Kim et al.

(10) Patent No.: US 12,595,615 B2
(45) Date of Patent: Apr. 7, 2026

(54) WASHING MACHINE

(71) Applicant: LG Electronics Inc., Seoul (KR)

(72) Inventors: Beomjun Kim, Seoul (KR); Sangjun Lee, Seoul (KR); Sunjung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 249 days.

(21) Appl. No.: 18/560,847

(22) PCT Filed: May 17, 2022

(86) PCT No.: PCT/KR2022/007061
§ 371 (c)(1),
(2) Date: Nov. 14, 2023

(87) PCT Pub. No.: WO2022/245108
PCT Pub. Date: Nov. 24, 2022

(65) Prior Publication Data

US 2024/0247425 A1 Jul. 25, 2024

(30) Foreign Application Priority Data

May 18, 2021 (KR) ..... 10-2021-0063935

(51) Int. Cl.
*D06F 39/08* (2006.01)
*D06F 23/02* (2006.01)
(Continued)

(52) U.S. Cl.
CPC ..... *D06F 39/085* (2013.01); *D06F 23/02* (2013.01); *D06F 23/06* (2013.01); *D06F 39/10* (2013.01)

(58) Field of Classification Search
CPC ..... D06F 39/085; D06F 39/10; D06F 23/02; D06F 23/06
See application file for complete search history.

(56) References Cited

U.S. PATENT DOCUMENTS 6,167,733 B1 * 1/2001 Lee ..... D06F 39/10 68/18 F
2005/0201552 A1 9/2005 Arisawa et al.
(Continued)

FOREIGN PATENT DOCUMENTS

EP 3293304 A1 3/2018
EP 4148176 A1 3/2023
(Continued)

OTHER PUBLICATIONS

Extended European Search Report in European Appln. No. 22804962.3, mailed on Jan. 10, 2025, 9 pages.
(Continued)

*Primary Examiner* — Joseph L. Perrin
(74) *Attorney, Agent, or Firm* — Fish & Richardson P.C.

(57) ABSTRACT

The present disclosure relates to a washing machine. The washing machine includes a tub, a drum rotatably provided in the tub, and a pump for draining and circulating wash water. The pump includes a pump housing, a drain chamber formed in the pump housing, a drain pump mounted in the drain chamber and provided with a drain impeller for generating a drain pressure in the drain chamber, a first drain hose connector extending from the upper portion of the drain chamber to drain the wash water in response to rotation of the impeller in one direction, a second drain hose connector extending from the lower portion of the drain chamber to drain the wash water in response to rotation of the impeller in the opposite direction, a first drain hose connected to the first drain hose connector, and a second drain hose connected to the second drain hose connector.

19 Claims, 8 Drawing Sheets

(51) Int. Cl.
*D06F 23/06* (2006.01)
*D06F 39/10* (2006.01)

(56) References Cited

U.S. PATENT DOCUMENTS

| | | | | |
|---|---|---|---|---|
| 2007/0246089 | A1 | 10/2007 | Welch | |
| 2012/0025025 | A1 | 2/2012 | Brennan et al. | |
| 2013/0074554 | A1 | 3/2013 | Chun et al. | |
| 2020/0024793 | A1* | 1/2020 | Kim | F04D 13/086 |
| 2021/0285143 | A1* | 9/2021 | Cheon | D06F 37/304 |
| 2023/0167597 | A1* | 6/2023 | Lee | F04D 9/003 68/3 R |

FOREIGN PATENT DOCUMENTS

| | | | |
|---|---|---|---|
| KR | 10-2008-0040405 | | 5/2008 |
| KR | 10-2013-0034311 | | 4/2013 |
| KR | 10-2013-0134698 | | 12/2013 |
| KR | 10-2016-0102707 | | 8/2016 |
| KR | 10-1735432 | | 5/2017 |
| KR | 10-2018-0076212 | | 7/2018 |
| WO | 2019/210974 | A1 | 11/2019 |

OTHER PUBLICATIONS

International Search Report and Written Opinion in Appln. No. PCT/KR2022/007061, mailed on Aug. 26, 2022, 9 pages.
Notice of Allowance in Korean Appln. No. 10-2021-0063935, mailed on Jul. 18, 2023, 12 pages (with English translation).

* cited by examiner

[Fig. 1]
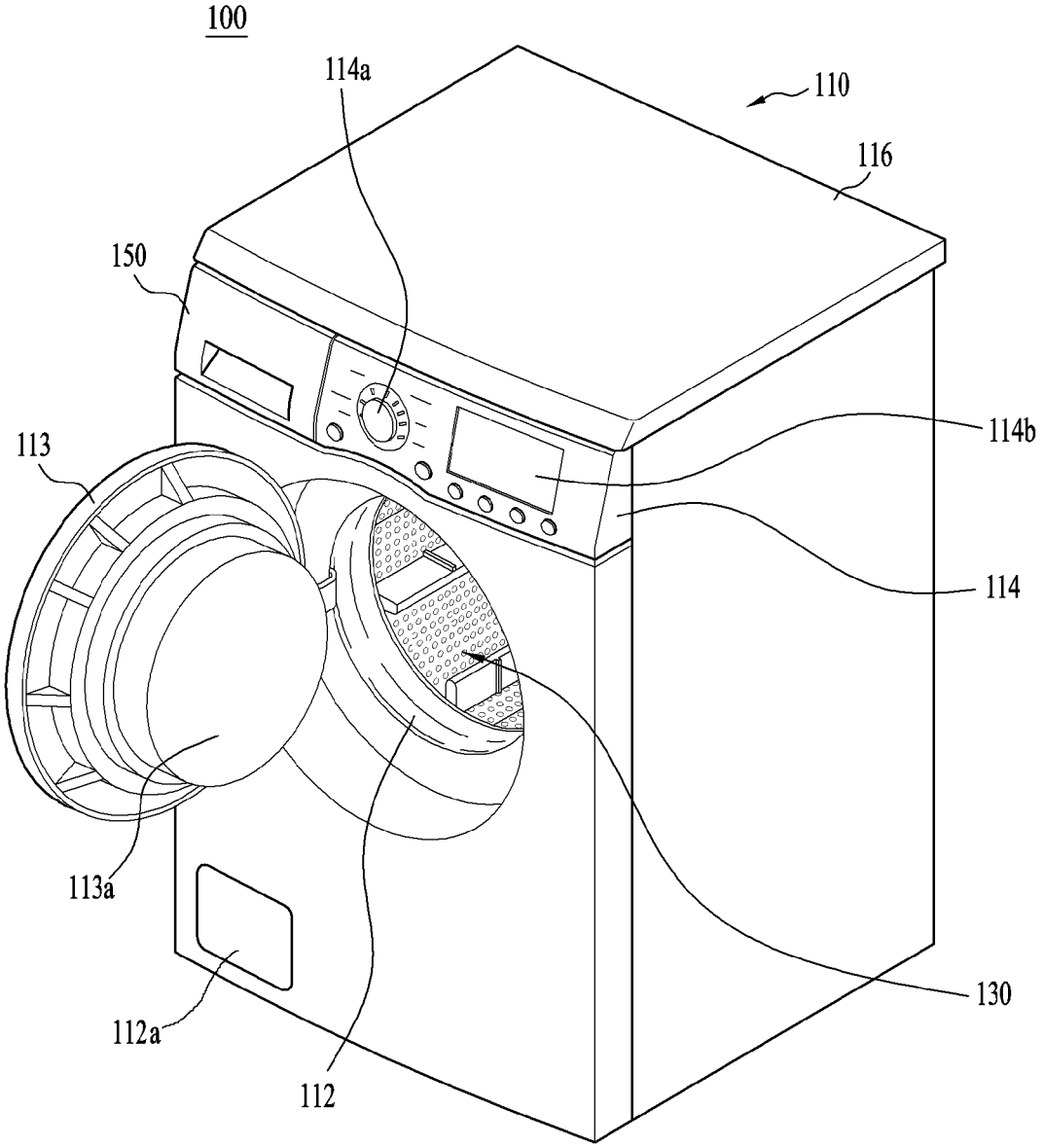

[Fig. 2]
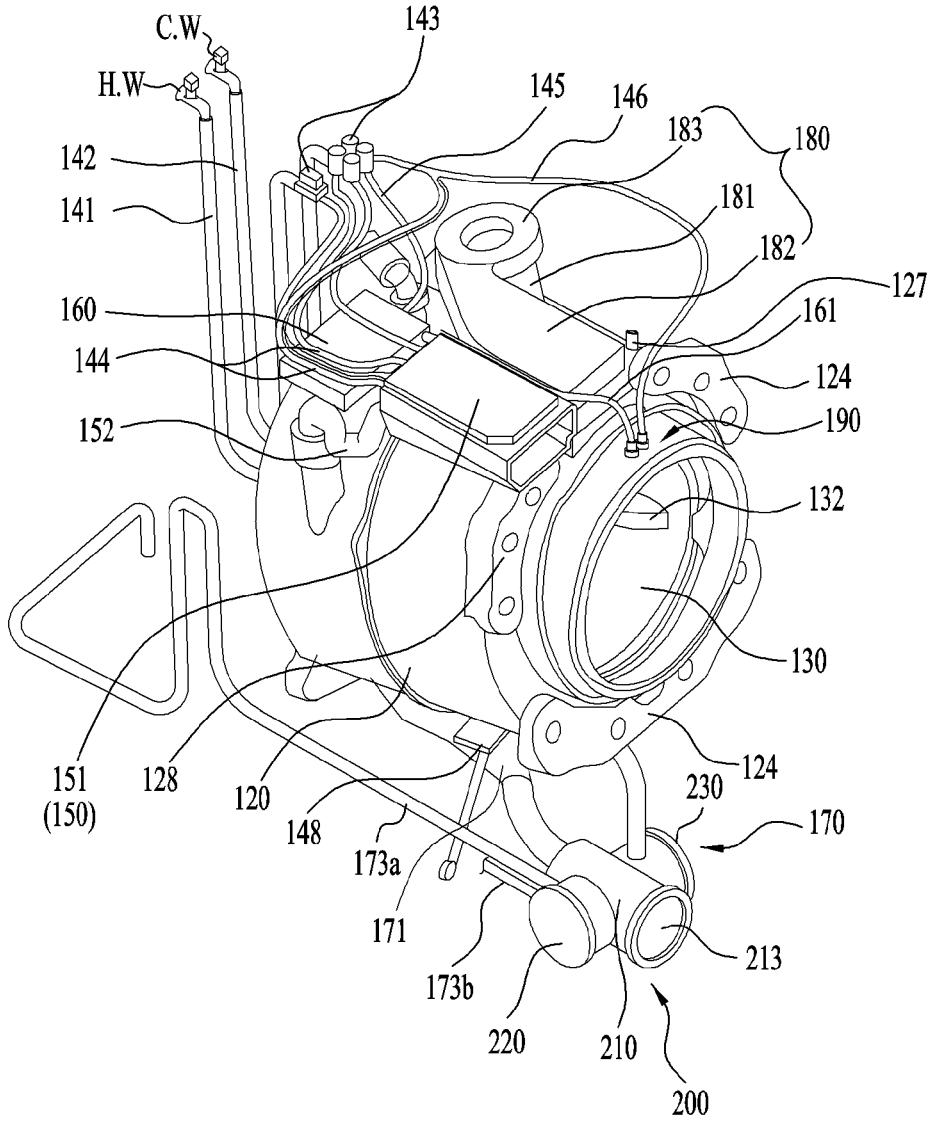

[Fig. 3]
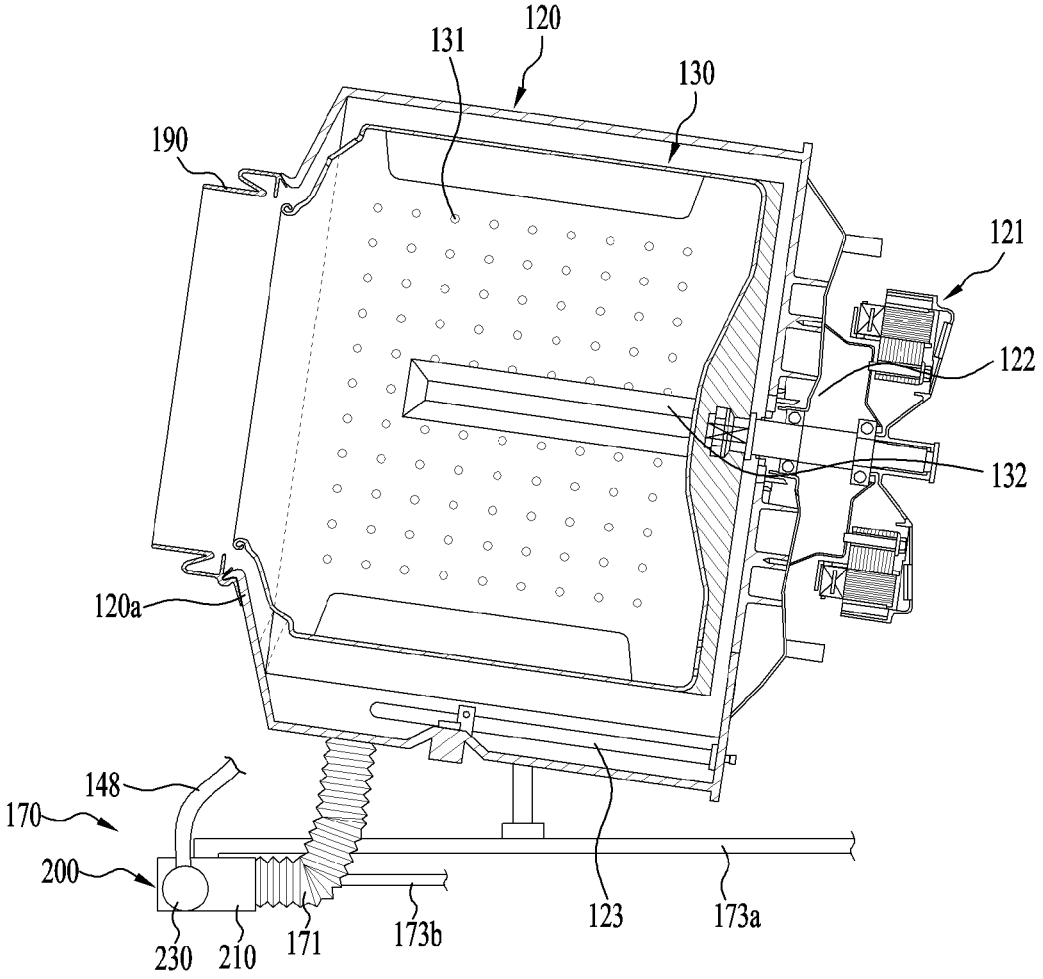

[Fig. 4]
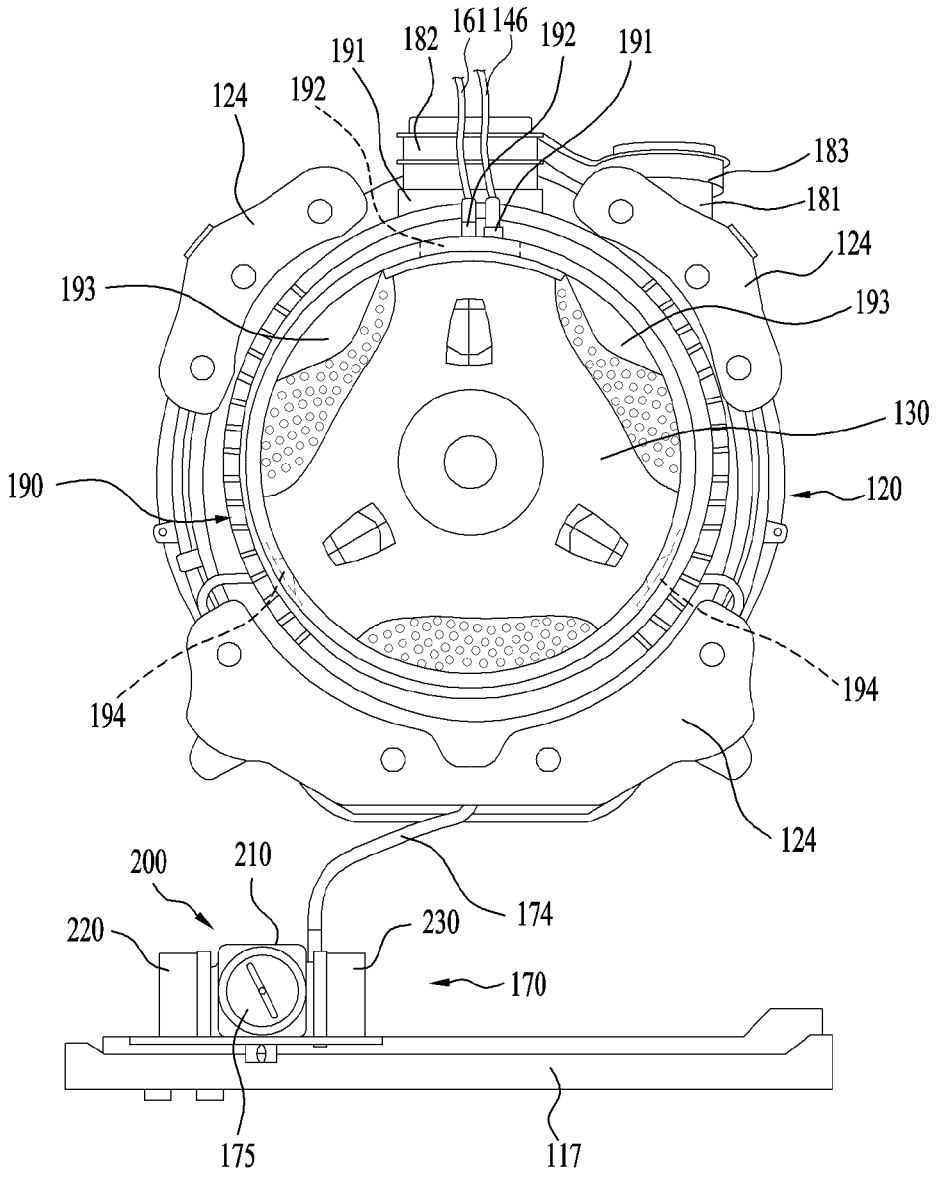

[Fig. 5]
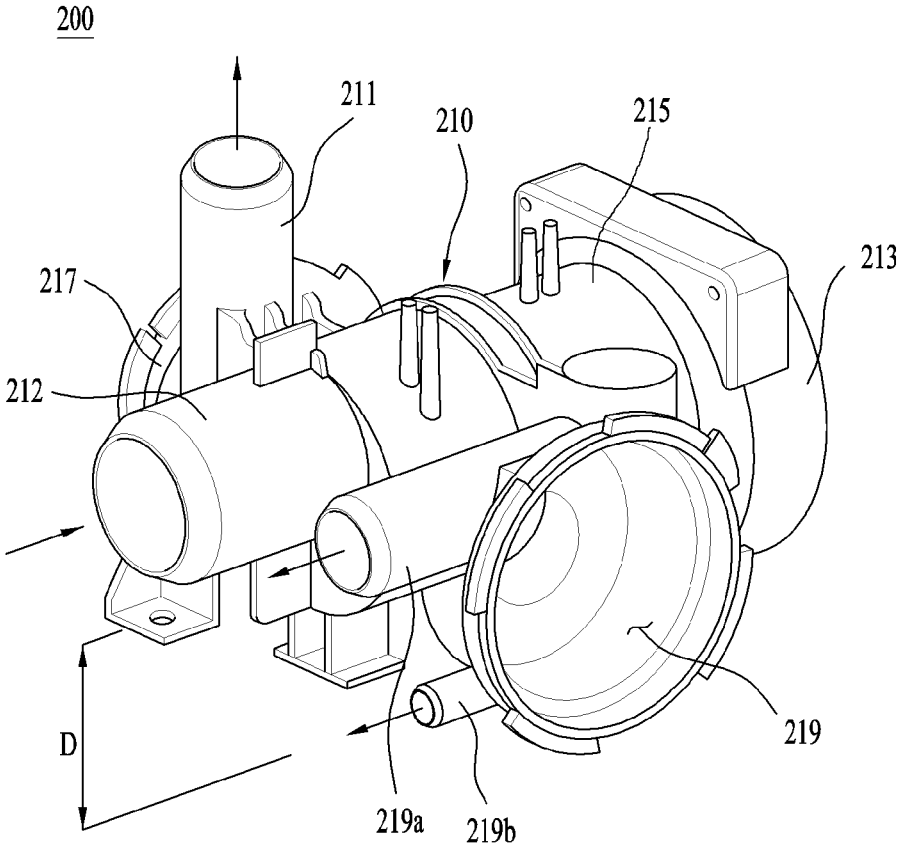
[Fig. 6]
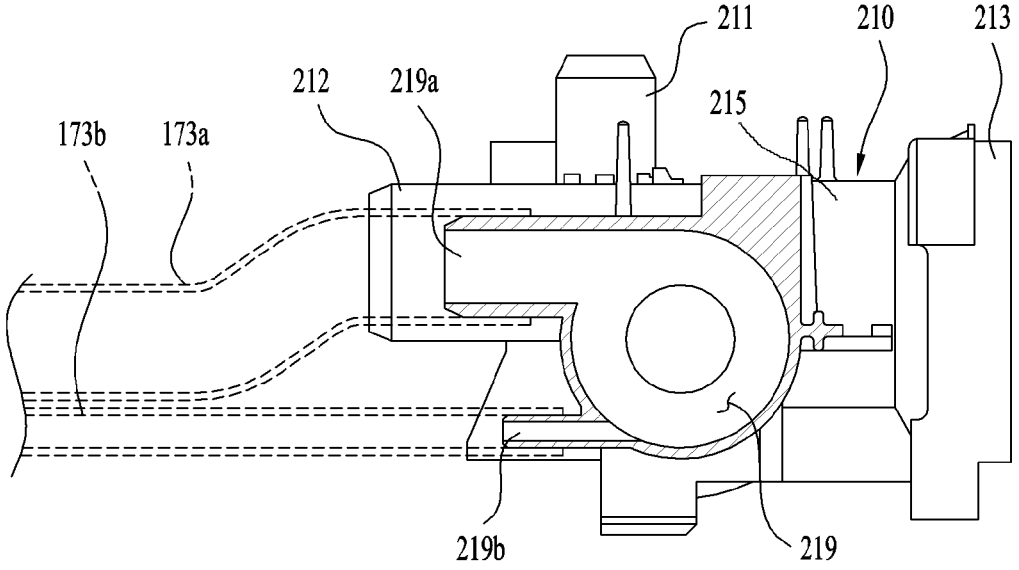

[Fig. 7]
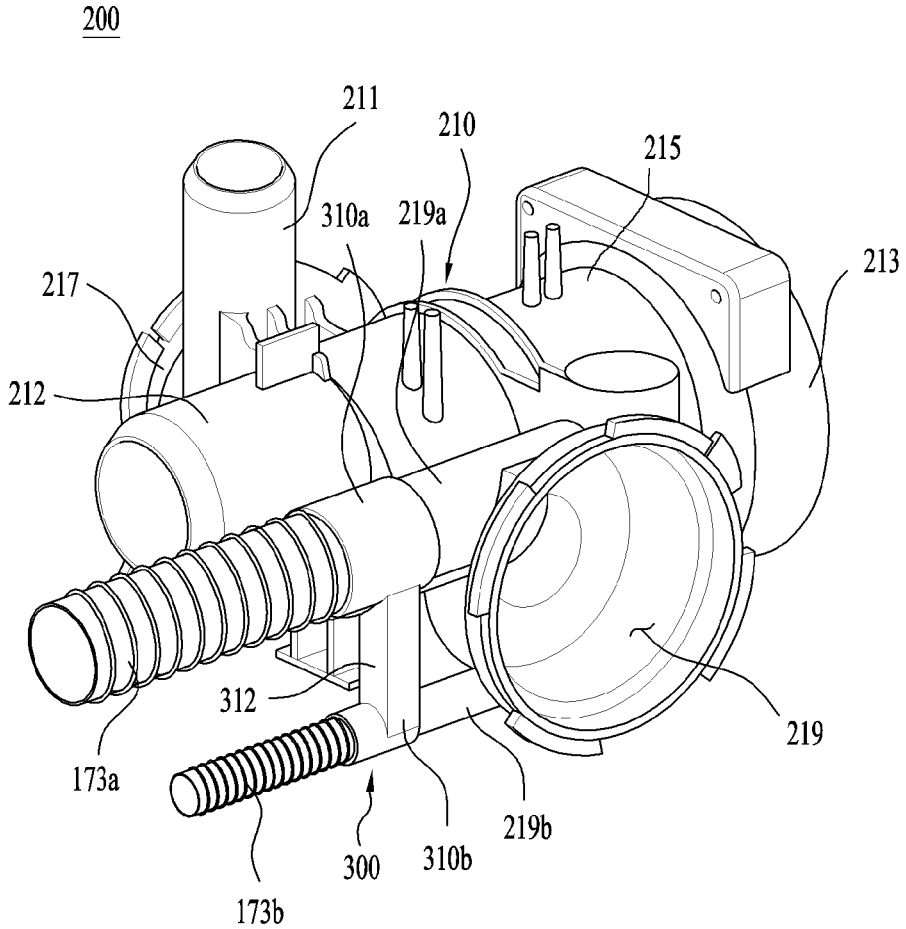
[Fig. 8]
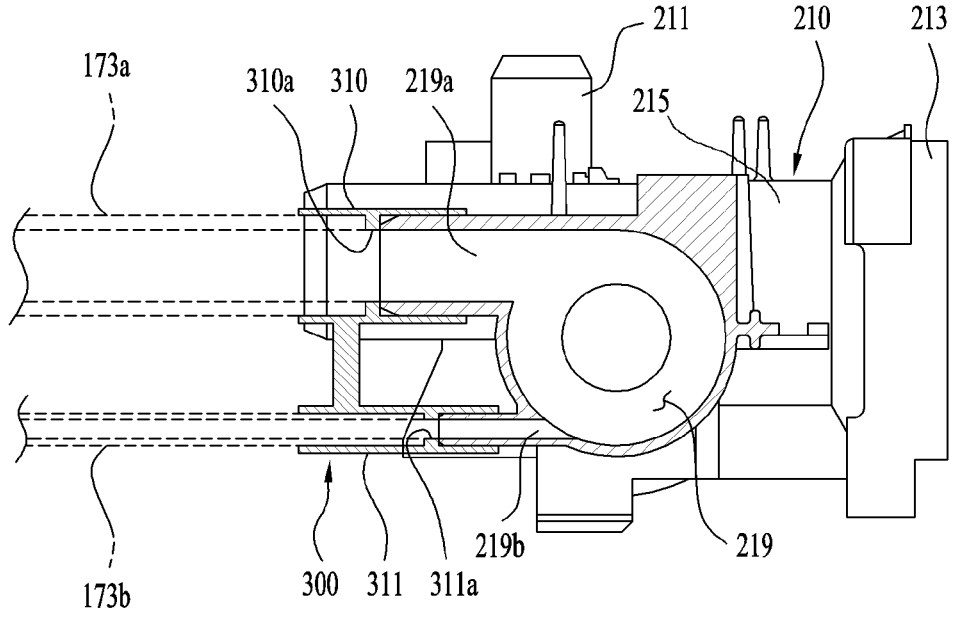

[Fig. 9]
200
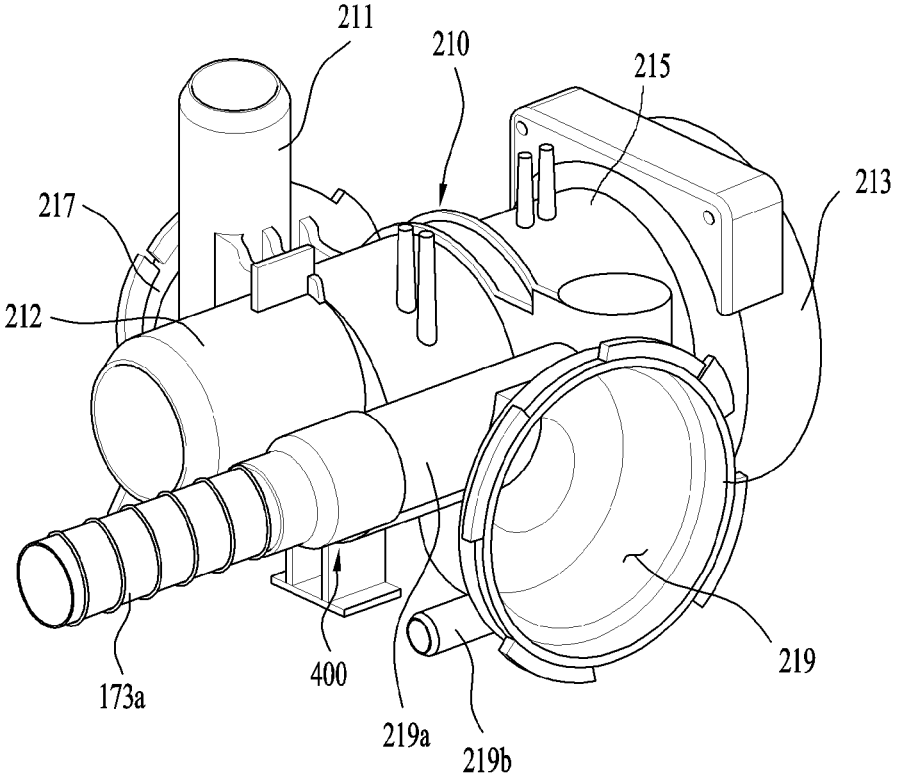
[Fig. 10]
200
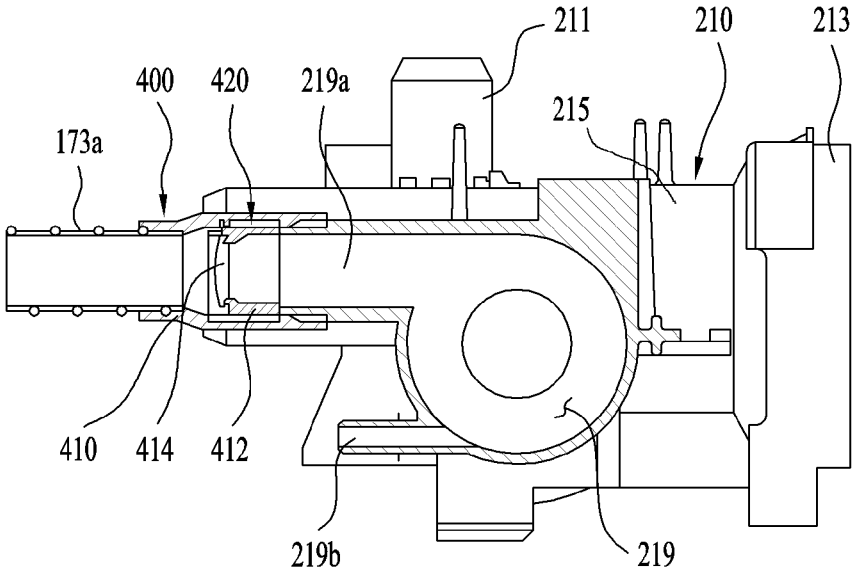

[Fig. 11]
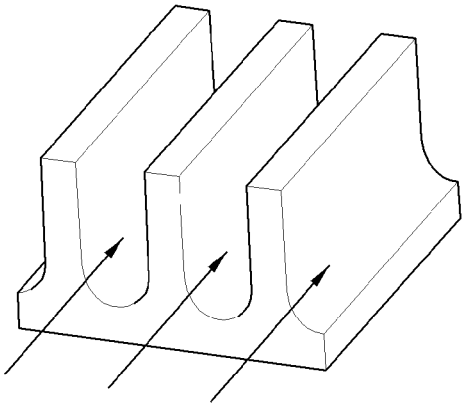
(a)
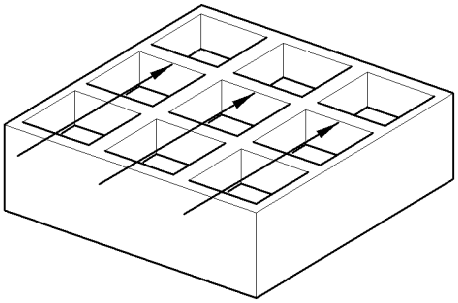
(b)

WASHING MACHINE

CROSS-REFERENCE TO RELATED APPLICATIONS

This application is a National Stage application under 35 U.S.C. § 371 of International Application No. PCT/KR2022/007061, filed on May 17, 2022, which claims the benefit of Korean Application No. 10-2021-0063935, filed on May 18, 2021. The disclosures of the prior applications are incorporated by reference in their entirety.

TECHNICAL FIELD

The present disclosure relates to a washing machine, and more particularly to a washing machine capable of minimizing the amount of water remaining in a pump of the washing machine.

BACKGROUND ART

In general, a washing machine is an apparatus that washes laundry through washing, rinsing, and spin-drying cycles according to a predetermined algorithm, and is categorized into a pulsator type, an agitator type, and a drum type according to a washing manner. A drum-type washing machine, which employs a drum-type washing manner, has advantages of minimum damage to laundry and minimum use of wash water compared to other types of washing machines, and is thus widely used.

Meanwhile, a general washing machine is provided with a separate pump for draining wash water used for washing after a washing cycle.

Korean Patent Laid-Open Publication No. 2002-0089776 (hereinafter referred to as a "conventional art") discloses a pump of a conventional washing machine. A pump of a conventional washing machine will be described briefly with reference to the conventional art.

As disclosed in the conventional art, a conventional drum-type washing machine broadly includes a main body, a control panel, which is mounted on the upper portion of the main body to receive user input related to a washing function and a washing time, a tub, which is fixed in the main body by means of a damper, a drum, which is mounted in the tub to receive laundry introduced thereinto, and a motor, which transmits driving force to the drum via a belt to rotate the drum in order to execute washing-related cycles.

In addition, there are provided a bellows hose for discharging wash water used in a washing cycle (or a rinsing cycle) from the tub, a pump housing to which the bellows hose is connected, a circulation pump connected to one side of the pump housing, a circulation hose connected at one end thereof to the circulation pump and connected at the other end thereof to the tub, a pump connected to the other side of the pump housing, and a drain hose connected at one end thereof to the pump.

In the washing machine configured as described above, the pump operates as follows. During the washing cycle (or the rinsing cycle), the circulation pump operates so that the wash water stored in the tub circulates in the tub through the circulation hose, and after the washing cycle (or the rinsing cycle) is completed, the pump operates so that the wash water stored in the tub is discharged outside the washing machine through the drain hose.

According to the above-mentioned conventional art, wash water, which contains detergent supplied to remove contaminants from laundry and contaminants removed from the laundry, remains in the tub, and the pump functions to discharge this wash water.

However, after the washing cycle (or the rinsing cycle) is completed, wash water may remain in the conventional pump for draining wash water. If the wash water remains in the pump for a long period of time, detergent or contaminants contained in the wash water may cause odors, thus giving an unpleasant feeling to a user, or may cause hygienic problems.

In addition, if detergent or contaminants remain in the pump for a long period of time, the detergent or the contaminants may be adhered to the inside of the pump, which may disturb the normal operation of the pump or may cause malfunction of the pump.

DISCLOSURE OF INVENTION

Technical Problem

The present disclosure has been made in an effort to solve the above problems, and an object of the present disclosure is to provide a washing machine capable of minimizing the amount of wash water remaining in a pump for draining wash water outside the washing machine by improving the flow path of the pump.

In addition, the present disclosure has been made in an effort to solve the above problems, and an object of the present disclosure is to provide a washing machine capable of preventing the generation of odors in a pump by minimizing the amount of wash water remaining in the pump.

In addition, the present disclosure has been made in an effort to solve the above problems, and an object of the present disclosure is to provide a washing machine capable of preventing malfunction of a pump by minimizing the amount of wash water remaining in the pump.

However, the objects of the present disclosure are not limited to the above-described objects, and other objects not mentioned herein may be clearly understood by those skilled in the art from the following description.

Solution to Problem

A washing machine according to an embodiment of the present disclosure for accomplishing the above objects includes a tub storing wash water therein, a drum rotatably provided in the tub, and a pump provided at the tub to drain and circulate the wash water, wherein the pump includes a pump housing configured to receive the wash water flowing out of the tub, a drain chamber formed in one side of the pump housing and having a drain space formed therein, a drain pump mounted in the drain chamber and provided with a drain impeller configured to generate a drain pressure in the drain chamber, a first drain hose connector extending from the upper portion of the drain chamber in a direction parallel to the horizontal direction to drain the wash water in response to rotation of the impeller in one direction, a second drain hose connector extending from the lower portion of the drain chamber in a direction parallel to the horizontal direction to drain the wash water in response to rotation of the impeller in the opposite direction, a first drain hose connected to the first drain hose connector, and a second drain hose connected to the second drain hose connector.

The first drain hose connector may have a larger diameter than the second drain hose connector.

The second drain hose connector may be formed adjacent to the lower end portion of the drain chamber.

The washing machine may further include a drain hose unit provided at end portions of the first drain hose and the second drain hose and connected to the first drain hose connector and the second drain hose connector.

The first drain hose, the second drain hose, and the drain hose unit may be integrally formed with each other.

The drain hose unit may include a first drain hose coupler configured to allow the first drain hose and the first drain hose connector to be coupled thereto, a second drain hose coupler configured to allow the second drain hose and the second drain hose connector to be coupled thereto, and a connection rib configured to interconnect the first drain hose coupler and the second drain hose coupler.

The first drain hose connector may be formed to be longer than the second drain hose connector. The first drain hose coupler may first be coupled to the first drain hose connector, and thereafter, the second drain hose coupler may be coupled to the second drain hose connector.

The washing machine may further include a backflow prevention unit provided between the first drain hose connector and the first drain hose to prevent backflow of wash water remaining in the first drain hose.

The backflow prevention unit may include a pump coupling part, to which the first drain hose and the first drain hose connector are coupled, and a check valve, which is located between the first drain hose and the first drain hose connector inside the pump coupling part in order to prevent backflow of the wash water remaining in the first drain hose.

The washing machine may further include a circulation hose configured to circulate the wash water in the tub and a circulation nozzle configured to spray the wash water into the drum. The pump may further include a circulation chamber formed in the opposite side of the pump housing, a circulation hose connector formed at the upper portion of the circulation chamber and configured to allow the circulation nozzle to be connected thereto, and a circulation pump mounted in the circulation chamber and provided with a circulation impeller configured to generate a circulation pressure in the circulation chamber.

The pump housing may have a filter insertion hole formed therein so as to be open toward the front side of the washing machine to allow a filter to be detachably inserted thereinto. The washing machine may further include a filter door mounted to the front surface of the washing machine at a position corresponding to the position of the filter insertion hole to enable mounting and demounting of the filter. The filter may be mounted in or demounted from the filter insertion hole through the filter door.

The first drain hose and the second drain hose may extend to the outside of the washing machine, and end portions of the first drain hose and the second drain hose may converge using a converging member.

The first drain hose and the second drain hose may have inner surfaces formed to have a riblet pattern.

Advantageous Effects of Invention

According to a washing machine according to an embodiment of the present disclosure, it is possible to minimize the amount of wash water remaining in a pump for draining wash water outside the washing machine by improving the flow path of the pump.

In addition, according to a washing machine according to an embodiment of the present disclosure, it is possible to prevent the generation of odors in a pump by minimizing the amount of wash water remaining in the pump.

In addition, according to a washing machine according to an embodiment of the present disclosure, it is possible to prevent malfunction of a pump by minimizing the amount of wash water remaining in the pump.

However, the effects of the present disclosure are not limited to the above-described effects, and other effects not mentioned herein may be clearly understood by those skilled in the art from the claims.

BRIEF DESCRIPTION OF DRAWINGS

FIG. 1 is a perspective view showing a washing machine according to the present disclosure.

FIG. 2 is a partial perspective view showing the inner structure of the washing machine according to the present disclosure.

FIG. 3 is a partial cross-sectional view showing the inner structure of the washing machine according to the present disclosure.

FIG. 4 is a front view showing the inner structure of the washing machine according to the present disclosure.

FIG. 5 is a perspective view showing a pump of the washing machine according to an embodiment of the present disclosure.

FIG. 6 is a cross-sectional view showing the pump of the washing machine according to an embodiment of the present disclosure.

FIG. 7 is a perspective view showing a pump of the washing machine according to another embodiment of the present disclosure.

FIG. 8 is a cross-sectional view showing the pump of the washing machine according to the other embodiment of the present disclosure.

FIG. 9 is a perspective view showing a pump of the washing machine according to still another embodiment of the present disclosure.

FIG. 10 is a cross-sectional view showing the pump of the washing machine according to the still other embodiment of the present disclosure.

FIG. 11 is an exemplary view showing the inner surface of a drain hose according to an embodiment of the present disclosure.

BEST MODE FOR CARRYING OUT THE INVENTION

Advantages and features of the present disclosure and methods for achieving them will be made clear from embodiments described below in detail with reference to the accompanying drawings. The present disclosure may, however, be embodied in many different forms, and should not be construed as being limited to the embodiments set forth herein. In addition, it is to be understood that the present disclosure includes all modifications, equivalents, and substitutions which fall within the spirit and scope of the present disclosure. Rather, these embodiments are provided so that this disclosure will be thorough and complete, and will fully convey the scope of the disclosure to those skilled in the art. In the following description of the present disclosure, a detailed description of known functions and configurations incorporated herein will be omitted when it may obscure the subject matter of the present disclosure.

The terminology used herein is for the purpose of describing particular embodiments only and is not intended to be limiting of exemplary embodiments of the disclosure. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, components, or groups thereof, but do not preclude the presence or addition of one or more other features, integers, steps, operations, elements, components, or groups thereof. It may be understood that, although the terms "first," "second," etc. may be used herein to describe various elements, these elements are not to be construed as being limited by these terms. These terms are generally only used to distinguish one element from another.

In the following description, the name of each constituent element in the present disclosure is defined taking into consideration the function of the constituent element. Therefore, the technical meaning of each constituent element should not be limited to the name of each constituent element. In the present technical field, each constituent element may also be designated by a name other than the name defined in this description.

Hereinafter, a washing machine according to an embodiment of the present disclosure will be described in detail with reference to the accompanying drawings.

First, a washing machine according to an embodiment of the present disclosure will be described in detail with reference to FIGS. 1 to 4.

FIG. 1 is a perspective view showing a washing machine according to the present disclosure, FIG. 2 is a partial perspective view showing the inner structure of the washing machine according to the present disclosure, FIG. 3 is a partial cross-sectional view showing the inner structure of the washing machine according to the present disclosure, and FIG. 4 is a front view showing the inner structure of the washing machine according to the present disclosure.

As shown in FIGS. 1 to 4, a washing machine 100 according to an embodiment of the present disclosure may include a cabinet 110, which forms the external appearance of the washing machine 100, a tub 120, which is disposed in the cabinet 110 and stores wash water therein, a drum 130, which is rotatably disposed in the tub 120, a water supply unit 140 for supplying the wash water to the tub 120, a detergent dispenser 150, which mixes the water supplied from the water supply unit 140 with detergent to form a mixture and supplies the mixture to the tub 120, a steam generator 160, which heats the water supplied from the water supply unit 140 to supply steam to the tub 120, a drain unit 170, which discharges the wash water after washing, and a dryer 180, which heats air in the tub and supplies/circulates the heated air.

Meanwhile, the washing machine of the present disclosure includes a gasket 190 between the cabinet 110 and the tub 120. The gasket 190 functions to prevent the water stored in the tub 120 from leaking to the gap between the tub 120 and the cabinet 110.

Here, a water supply nozzle 191 for supplying the water supplied from water supply sources HW and CW to the drum 130 and to the inner surface of the gasket 190 at the same time may be provided on the top of the gasket 190. Circulation nozzles 194, through which the wash water supplied to the tub 120 is circulated by the drain unit 170 and flows back to the tub 120, may be provided on both sides of the gasket 190.

The cabinet 110, which forms the external appearance of the washing machine 100, may include side surface cabinets 115 forming the side surfaces of the washing machine 100, a base 117 forming the bottom surface of the washing machine 100, a front surface cabinet 111, which has a laundry entrance 112 formed therein to allow laundry to be introduced into or withdrawn out of the washing machine 100 and is coupled to the front surfaces of the side surface cabinets 115, an upper surface cabinet 116 disposed on the side surface cabinets 115, and a door 113 pivotably coupled to the front surface cabinet 111 to open and close the laundry entrance 112.

Meanwhile, a control panel 114 is disposed on the upper portion of the front surface cabinet 111. The control panel 114 may include a course selection unit **114*a* for receiving course selection input from a user, and a display 114*b* for receiving various control commands from the user and displaying the operating state of the washing machine 100**.

In addition, the door 113 may be provided with a glass **113*a* so that the laundry in the drum 130 is observed from the outside of the washing machine 100. The glass 113*a* may be formed in a convex shape. The tip of the glass 113*a* may be positioned inside the drum 130 in the state in which the door 113** is closed.

The tub 120 may be formed in a shape suspended in the cabinet 110. A motor 121 and a rotary shaft 122 for rotating the drum 130 may be disposed at the rear of the tub 120. Here, the drum 130 may be categorized into a direct driving-type drum and an indirect driving-type drum depending on the manner in which the driving force provided from the motor 121 is transferred to the drum 130.

Here, the direct driving-type drum is structured such that the rotary shaft of the motor is directly coupled to the drum 130, and the rotary shaft of the motor and the center of the drum 130 are aligned on the same line. The washing machine 100 according to this embodiment employs the direct driving-type drum, in which the drum 130 is rotated by the motor 121 disposed at the rear of the tub 120. However, the present disclosure is not limited thereto, and the indirect driving-type drum to be described later is also applicable to the present disclosure.

The indirect driving-type drum is structured such that the drum 130 is rotated using power transmission means for transmitting the driving force provided from the motor, such as a belt or a pulley. In this case, the rotary shaft of the motor and the center of the drum 130 are not necessarily aligned on the same line.

In order to absorb vibration generated during rotation of the drum 130, the tub 120 described above may be suspended from the cabinet 110 using a spring (not shown), or a damper (not shown) may be further provided to support the tub 120 from below.

In addition, a heater 115 for heating the water stored in the tub 120 may be further provided in the tub 120. In addition, a weight 116 for increasing the weight of the tub 120 to raise a vibration limit of the tub may be disposed on the front surface of the tub 120.

The drum 130 is disposed in the tub so as to be connected to the rotary shaft, and is thus capable of being rotated by rotational force transmitted thereto from the motor 121. A plurality of through-holes 131 may be formed in the inner circumferential surface of the drum 130 so that the wash water stored in the tub 120 flows into the drum 130. In addition, one or more lifters 132 may be provided on the inner surface of the drum 130 along the inner circumferential surface of the drum 130 so that the laundry introduced into the drum 130 is moved by rotation of the drum 130.

Meanwhile, the tub 120 and the drum 130 may be disposed in a horizontal state. Alternatively, the tub 120 and the drum 130 may be disposed to have a predetermined inclination such that the rear portions thereof are positioned lower than the front portions thereof.

The water supply unit 140 may include a plurality of water supply valves 143 and a plurality of water supply hoses 144, 145, and 146 in order to supply water supplied from the external water supply sources HW and CW to the tub 120, the detergent dispenser 150, the steam generator 160, and the like.

Here, the water supply unit 140 may be connected to the hot water supply source HW for supplying hot water via a hot water hose 141, and may be connected to the cold water supply source CW for supplying cold water via a cold water hose 142. The water introduced through the hot water hose 141 and the cold water hose 142 may be supplied to the detergent dispenser 150, the steam generator 160, and/or the water supply nozzle 191 through the appropriate control of the water supply valve 143.

The water supply unit 140 may include a dispenser water supply hose 144 for guiding water to the detergent dispenser 150, a steam water supply hose 145 for guiding water to the steam generator 160, and a front water supply hose 146 for guiding water to the water supply nozzle 191.

The detergent dispenser 150 may temporarily store an additive, such as detergent for preliminary or main laundry washing, fabric softener, or bleach, may mix the wash water supplied from the water supply unit 140 with the additive to form a mixture, and may supply the mixture to the tub 120.

Meanwhile, the detergent dispenser 150 may have a plurality of accommodation spaces (not shown) separately formed therein so that the additives are separately accommodated without mixing with each other, and water may be independently supplied to each accommodation space.

The detergent dispenser 150 may include a detergent dispenser housing 151 formed so as to be recessed into the cabinet 110, and may be formed in a drawer shape so as to be withdrawn out of the detergent dispenser housing 151 in the forward direction of the cabinet 110.

Here, the detergent dispenser housing 151 communicates with the tub 120 through a water supply bellows 152. Therefore, the water supplied from the water supply unit 140 may mix with the additive via the detergent dispenser 150, and may then flow into the tub 120 along the water supply bellows 152 connected to the detergent dispenser housing 151.

The steam generator 160 is a device for generating steam by heating the water supplied from the water supply unit 140. The steam generator 160 may supply the generated steam from the front side of the drum 130 in order to perform sterilization, wrinkle removal, and the like of the laundry inside the drum 130.

The drain unit 170 is disposed below the tub 120 in order to drain the wash water from the tub 120 after washing is completed. The drain unit 170 may include a drain bellows 171 connected to the lower portion of the tub 120, a pump 172 for pumping the wash water drained through the drain bellows 171, a drain hose **173*a* for draining the wash water moved by the pump 172, and a circulation hose 174 for circulating the wash water moved by the pump 172** back to the tub.

Meanwhile, the pump 200 may include a pump housing 210, which forms the body of the pump 200, a drain pump 220, which is mounted to one side of the pump housing 210 to rotate a drain impeller (not shown), and a circulation pump 230, which is mounted to the opposite side of the pump housing 210 to rotate a circulation impeller (not shown). The pump will be described later in more detail with reference to other drawings.

Here, the drain hose **173*a* may extend so as to form a trap on a portion of the drain hose 173*a* that is disposed outside the washing machine 100. The circulation hose 174 may diverge into at least two circulation hoses, and the at least two circulation hoses may be connected to the circulation nozzles 194 formed on both sides of the gasket 190**.

Therefore, when the pump 172 operates, the wash water in the tub 120 may be drained through the drain hose **173*a*, or may be supplied back to the tub 120 through the circulation nozzles 194. To this end, the pump 172 may be provided with a three-way valve (not shown), which sets a flow path such that the water moved by the pump 172 is selectively moved to the drain hose 173*a* or the circulation hose 174**.

In this embodiment, the pump 172 has been described as performing both the function of a pump and the function of a circulation pump. Alternatively, a pump for drainage and a pump for circulation may be separately provided from each other.

The dryer 180 heats and circulates the air in the tub 120, and guides flow of the air so that the air moves back into the tub 120. The dryer 180 may include a suction duct 181 for suctioning the air in the tub 120 and a supply duct 182 for guiding the moving air to the tub 120.

Meanwhile, a blowing fan 183 for generating a pressure to move air is provided between the suction duct 181 and the supply duct 182. The suction duct 181 interconnects the outer circumferential surface of the rear side of the tub 120 and the blowing fan 183, and the supply duct 182 interconnects the blowing fan 183 and the gasket 190. In addition, a heater 115 for heating the air flowing through the supply duct 182 may be further provided in the supply duct 182.

The gasket 190 is coupled at one side thereof to the front surface cabinet 111, and is coupled at the opposite side thereof to the circumference of the open front surface portion of the tub 120. The gasket 190 may be formed in the shape of a bellows that is elastically expanded or contracted in response to vibration of the tub 120 in order to absorb the vibration. Here, the gasket 190 may be made of a deformable or flexible material, which is elastic to some extent. The gasket 190 may be made of natural rubber or synthetic resin.

Meanwhile, as described above, a duct connection portion 191, to which the supply duct 182 of the dryer 180 is connected, is formed on the rear side of the upper portion of the gasket 190. In addition, a water supply nozzle 191 may be disposed on the front side of the upper portion of the gasket 190, and a plurality of circulation nozzles 194 for spraying water into the drum 130 may be formed on both sides of the lower portion of the inner circumferential surface of the gasket 190. The circulation hose 174, which extends from the drain unit 170, may be connected to each of the circulation nozzles 194.

In addition, jamming prevention protrusions 193 are formed on both sides of the upper portion of the inner circumferential surface of the gasket 190 so as to be symmetrical to each other. The jamming prevention protrusions 193 protrude toward the center of the gasket 190. The jamming prevention protrusions 193 function to prevent the laundry from escaping from the drum 130 due to rotation of the drum 130 and getting jammed between the gasket 190 and the cabinet 110, particularly, the front surface cabinet 111, or to prevent the laundry from spilling when the door 113 is opened after washing is completed.

Preferably, the jamming prevention protrusions 193 may protrude from the inner circumferential surface of the gasket 190 toward the laundry entrance. In addition, the jamming prevention protrusions 193 may be formed at a plurality of positions, and in particular, may be formed at positions symmetrical to each other with respect to the vertical center line of the gasket 190.

The plurality of circulation nozzles 194 may spray the wash water from the lower portion of the gasket 190 toward the rear side of the drum 130, thereby evenly wetting the laundry introduced into the drum.

Meanwhile, in the washing machine 100 described above, the drain unit 170 is located below the tub 120 in order to discharge wash water remaining in the tub 120, and the pump 200 is located at the lowermost position in the wash water passage of the washing machine 100. Therefore, after washing is completed, wash water may remain in the pump 200 (hereinafter referred to as "residual water"). If the residual water remains in the pump 200 for a long period of time, this may cause odors, thus giving an unpleasant feeling to a user.

Hereinafter, the pump 200 according to an embodiment of the washing machine 100 of the present disclosure described as above will be described in detail with reference to the accompanying drawings. Each of the elements mentioned below should be understood with reference to the description and the drawings of an embodiment of the above-described washing machine.

FIG. 5 is a perspective view showing the pump of the washing machine according to an embodiment of the present disclosure, and FIG. 6 is a cross-sectional view showing the pump of the washing machine according to an embodiment of the present disclosure.

As shown in the drawings, the pump 200 according to an embodiment of the present disclosure may include a pump housing 210, which forms the body of the pump 200, a drain pump 220, which is mounted to one side of the pump housing 210 to generate a drain pressure of the wash water, a circulation pump 230, which is mounted to the opposite side of the pump housing 210 to generate a circulation pressure of the wash water, and a filter (not shown), which is inserted into the pump housing 210 to remove foreign substances from the wash water flowing into the pump housing 210.

Here, the pump housing 210 is provided with a filter chamber 215, through which the wash water passes and in which foreign substances are removed from the wash water. The pump housing 210 is provided with a drain bellows connector 212, which extends toward the inside of the washing machine so that the drain bellows 171 is connected thereto. The wash water is guided to the filter chamber 215 through the drain bellows 171.

Meanwhile, the pump housing 210 has a filter insertion hole 213 formed therein so as to be open toward the front side of the washing machine 100 so that the filter is inserted thereinto. Meanwhile, a filter door 112*a* for enabling mounting/demounting of the filter may be provided at a position corresponding to the pump 200 below the front surface cabinet 111.

Here, the filter (not shown) may be inserted into the filter insertion hole 213 from the front side of the washing machine 100, and may be mounted in the filter chamber 215 of the pump housing 210. The filter may remove foreign substances from the wash water flowing into the filter chamber 215 from the drain bellows 171.

Meanwhile, the pump housing 210 is provided at one side thereof with a drain chamber 219 in which the drain pump 220 is mounted, and is provided at the opposite side thereof with a circulation chamber 217 in which the circulation pump 230 is mounted.

Here, the filter chamber 215, the drain chamber 219, and the circulation chamber 217, which are provided at the pump housing 210, communicate with each other so that the wash water introduced from the drain bellows 171 moves therethrough.

In addition, the drain pump 220 may be provided with a drain impeller (not shown), which is located in the drain chamber 219 to apply a drain pressure to the wash water flowing into the drain chamber 219. In addition, the circulation pump 230 may be provided with a circulation impeller (not shown), which is located in the circulation chamber 217 to apply a circulation pressure to the wash water flowing into the circulation chamber 217.

Meanwhile, the drain chamber 219 forms a space in which the drain impeller mounted to the rotary shaft of the drain pump 220 is capable of rotating, and the circulation chamber 217 forms a space in which the circulation impeller mounted to the rotary shaft of the circulation pump 230 is capable of rotating.

Here, the drain chamber 219 communicates with the filter chamber 215, and thus the wash water filtered by the filter in the filter chamber 215 flows into the drain chamber 219. Accordingly, the wash water moved by the drain pump 220 in the drain chamber 219 may be the wash water filtered by the filter in the filter chamber 215.

In addition, the drain chamber 219 is provided at the rear side thereof with a first drain hose connector 219*a*, to which a first drain hose 173*a* is connected, and a second drain hose connector 219*b*, to which a second drain hose 173*b* is connected.

The first drain hose connector 219*a* extends from the upper end of the drain chamber 219 toward the rear side of the washing machine 100 in a direction substantially parallel to the horizontal direction. The second drain hose connector 219*b* extends from the lower end of the drain chamber 219 toward the rear side of the washing machine 100 in a direction substantially parallel to the horizontal direction.

That is, the first drain hose connector 219*a* and the second drain hose connector 219*b* may be located to be respectively eccentric upwards and downwards from the center of the drain chamber 219 (or the center of rotation of the drain impeller).

Meanwhile, the drain impeller located in the drain chamber 219 may be rotated in the forward direction and the backward direction by the drain pump 220. Drainage through the first drain hose connector 219*a* or the second drain hose connector 219*b* may be determined depending on rotation of the drain impeller in the forward direction or the backward direction in the drain chamber 219.

For example, when the drain impeller rotates in the forward direction, a drain pressure may be applied to the wash water remaining in the drain chamber 219 toward the first drain hose connector 219*a*. Accordingly, when the drain pump 220 rotates in the forward direction, the wash water may be drained to the first drain hose 173*a* through the first drain hose connector 219*a*.

In addition, when the drain impeller rotates in the backward direction, a drain pressure may be applied to the wash water remaining in the drain chamber 219 toward the second drain hose connector 219*b*. Accordingly, when the drain pump 220 rotates in the backward direction, the wash water may be drained to the second drain hose 173*b* through the second drain hose connector 219*b*.

Meanwhile, the first drain hose connector 219*a* may have a larger diameter than the second drain hose connector 219*b*. The first drain hose connector 219*a* may be used for the purpose of draining the wash water stored in the tub, and the second drain hose connector 219*b* may be used for the purpose of draining the residual water present in the drain chamber 219, the first drain hose 173*a*, and the first drain hose connector 219*a*.

In addition, the first drain hose 173*a* may have a diameter corresponding to the diameter of the first drain hose connector 219*a*, and the second drain hose 173*b* may have a diameter corresponding to the diameter of the second drain hose connector 219*b*. Accordingly, the first drain hose 173*a* may have a larger diameter than the second drain hose 173*b*.

Meanwhile, the drain pump 220 may primarily rotate in one direction in order to drain the wash water stored in the tub. After the drain cycle is completed, the drain pump 220 may temporarily rotate in the opposite direction in order to drain the residual water present in the drain chamber 219, the first drain hose 173*a*, and the first drain hose connector 219*a* through the second drain hose connector 219*b*.

Accordingly, when the drain pump 220 rotates in the forward direction, the wash water may be drained through the first drain hose connector 219*a* and the first drain hose 173*a*, and when the drain pump 220 rotates in the backward direction, the wash water may be drained through the second drain hose connector 219*b* and the second drain hose 173*b*.

Therefore, the first drain hose connector 219*a* is formed so that the wash water in the drain chamber 219 is drained by rotation of the drain impeller in one direction, and the second drain hose connector 219*b* is formed so that the wash water in the drain chamber 219 is drained by rotation of the drain impeller in the opposite direction.

That is, the drain impeller provided at the drain pump 220 may selectively apply a drain pressure to the first drain hose connector 219*a* or the second drain hose connector 219*b* depending on rotation of the drain pump 220 in the forward direction or the backward direction.

After the wash water is drained through the first drain hose 173*a*, the wash water remaining in the first drain hose 173*a* may be additionally drained through the second drain hose 173*b* by the operation of the drain pump 220.

That is, when the drain pump 220 operates in the backward direction after drainage of the wash water through the first drain hose 173*a* by operation of the drain pump 220 in the forward direction, the pressure generated by the drain impeller is applied to the second drain hose connector 219*b*, and a negative pressure is generated in the first drain hose connector 219*a*.

Therefore, the wash water remaining in the first drain hose 173*a* may flow back into the drain chamber 219 by the negative pressure generated in the first drain hose connector 219*a*. The wash water flowing back into the drain chamber 219 may be discharged through the second drain hose 173*b* by the pressure generated in the second drain hose connector 219*b*.

Meanwhile, the first drain hose 173*a* and the second drain hose 173*b* may converge into one drain hose using a separate member at a position near a drain, to which the wash water is discharged. That is, the first drain hose 173*a* and the second drain hose 173*b*, which are respectively connected to the first drain hose connector 219*a* and the second drain hose connector 219*b* of the drain chamber 219, may extend separately from each other to the outside of the washing machine 100, and may converge into one drain hose using a separate converging member outside the washing machine 100, thereby discharging the wash water to a drain.

Meanwhile, the circulation chamber 217 may be provided at the upper portion thereof with a circulation hose connector 211, to which a circulation hose 174 is connected. When the circulation pump 230 rotates, a pressure is applied to the wash water remaining in the circulation chamber 217, and thus the wash water moves to the circulation hose 174 through the circulation hose connector 211.

Here, the wash water moving to the circulation hose 174 may be injected into the drum 130 through the circulation nozzle 194 of the gasket 190. The circulation hose connector 211 may extend upwards from the upper side of the circulation chamber 217 in order to reduce the distance to the circulation nozzle 194.

Hereinafter, a pump 200 according to another embodiment of the washing machine 100 of the present disclosure described as above will be described in detail with reference to the accompanying drawings. The following description should be understood with reference to the configuration and the description of the pump according to the above-described embodiment.

FIG. 7 is a perspective view showing a pump of the washing machine according to another embodiment of the present disclosure, and FIG. 8 is a cross-sectional view showing the pump of the washing machine according to the other embodiment of the present disclosure.

In the case of the embodiment of the present disclosure described above, the first drain hose 173*a* and the second drain hose 173*b* are provided as separate hoses. In this case, the respective drain hoses 173*a* and 173*b* are connected to other components through individual processes, which may increase the number of processes.

Meanwhile, as shown in the drawings, the other embodiment of the present disclosure may include a drain hose unit 300, which enables a first drain hose 173*a* and a second drain hose 173*b* to be connected to other components through a single process.

The drain hose unit 300 is configured such that the first drain hose 173*a* and the second drain hose 173*b* are integrally formed with each other, and are simultaneously connected to the first drain hose connector 219*a* and the second drain hose connector 219*b* of the drain pump 220. The drain hose unit 300 may be provided with a first drain hose coupler 310, into which the first drain hose connector 219*a* is inserted, a second drain hose coupler 311, into which the second drain hose connector 219*b* is inserted, and a connection rib 312, which interconnects the first drain hose coupler 310 and the second drain hose coupler 311.

Here, the first drain hose coupler 310 may be formed in the shape of a cylinder that allows the first drain hose 173*a* and the first drain hose connector 219*a* to be respectively inserted into the two opposite ends thereof. In addition, the inner diameters of the two opposite ends of the first drain hose coupler 310 may be formed so as to respectively correspond to the outer diameter of the first drain hose 173*a* and the outer diameter of the first drain hose connector 219*a*. In addition, the first drain hose coupler 310 may include a first stopper 310*a*, which is formed on the center of the inner circumferential surface thereof in order to limit the distances of insertion of the first drain hose 173*a* and the first drain hose connector 219*a* thereinto.

In addition, the second drain hose coupler 311 may be formed in the shape of a cylinder that allows the second drain hose 173*b* and the second drain hose connector 219*b* to be respectively inserted into the two opposite ends thereof. In addition, the inner diameters of the two opposite ends of the second drain hose coupler 311 may be formed so as to respectively correspond to the outer diameter of the second drain hose 173*b* and the outer diameter of the second drain hose connector 219*b*. In addition, the second drain hose coupler 311 may include a second stopper 311*a*, which is formed on the center of the inner circumferential surface thereof in order to limit the distances of insertion of the second drain hose 173*b* and the second drain hose connector 219*b* thereinto.

Meanwhile, the first drain hose coupler 310 has an inner diameter corresponding to the outer diameter of the first drain hose connector 219*a*, and the second drain hose coupler 311 has an inner diameter corresponding to the outer diameter of the second drain hose connector 219*b*. In addition, the first drain hose coupler 310 and the second drain hose coupler 311 are supported by the connection rib so as to be spaced apart from each other by the same interval as that between the first drain hose connector 219*a* and the second drain hose connector 219*b*.

Here, the first drain hose coupler 310, the second drain hose coupler 311, and the connection rib 312 may be made of a synthetic resin material, and may integrally formed with each other through, for example, injection molding. In addition, the first drain hose 173*a* and the second drain hose 173*b* may be integrally formed with the first drain hose coupler 310, the second drain hose coupler 311, and the connection rib 312.

Alternatively, the first drain hose 173*a* and the second drain hose 173*b* may be formed through injection molding, and may then be inserted when the first drain hose coupler 310, the second drain hose coupler 311, and the connection rib 312 are injection-molded, with the result that all of these components may be integrated.

Alternatively, the first drain hose coupler 310, the second drain hose coupler 311, and the connection rib 312 may be integrally formed with each other, and thereafter, the first drain hose 173*a* and the second drain hose 173*b* may be inserted into and fixed in the first drain hose coupler 310 and the second drain hose coupler 311 using a separate adhesive member (not shown).

Therefore, when the drain hose unit 300 and the drain pump 220 are mounted, the first drain hose connector 219*a* and the second drain hose connector 219*b* are respectively inserted into the first drain hose coupler 310 and the second drain hose coupler 311 at the same time. In this way, the drain hose unit 300 may be mounted through a single process.

Meanwhile, the first drain hose connector 219*a* and the second drain hose connector 219*b*, which are provided at the drain pump 220, may extend to have different lengths. For example, the first drain hose connector 219*a* may be formed to be longer than the second drain hose connector 219*b*.

In this case, when the drain hose unit 300 and the drain pump 220 are mounted, the first drain hose connector 219*a* may be first inserted into the first drain hose coupler 310, and thereafter, the second drain hose connector 219*b* may be inserted into the second drain hose coupler 311. Accordingly, the mounting position of the drain hose unit 300 may be easily set, and the drain hose unit 300 may be mounted through a single process.

Hereinafter, a pump 200 according to still another embodiment of the washing machine 100 of the present disclosure described as above will be described in detail with reference to the accompanying drawings. The following description should be understood with reference to the configuration and the description of the pump according to the above-described embodiment.

FIG. 9 is a perspective view showing a pump of the washing machine according to still another embodiment of the present disclosure, and FIG. 10 is a cross-sectional view showing the pump of the washing machine according to the still other embodiment of the present disclosure.

As described above, the washing machine 100 of the present disclosure is designed to minimize the amount of wash water remaining in the pump 200 for draining the wash water, and the second drain hose connector 219*b* is provided to drain the wash water from the first drain hose 173*a* in order to reduce the amount of wash water remaining in the first drain hose 173*a*.

That is, the wash water drained to the second drain hose connector 219*b* may be the wash water remaining in the first drain hose 173*a*. If the amount of wash water remaining in the first drain hose 173*a* can be reduced, it may be possible to minimize the operation of the drain pump 220 in the backward direction for draining the wash water to the second drain hose connector 219*b*.

Therefore, in order to reduce the amount of wash water flowing backwards from the first drain hose 173*a* to the drain chamber 219, a backflow prevention unit 400 for preventing the wash water in the first drain hose 173*a* from flowing backwards may be further provided between the first drain hose 173*a* and the first drain hose connector 219*a*.

Here, the backflow prevention unit 400 may include a pump coupling part 410, which interconnects the first drain hose 173*a* and the first drain hose connector 219*a*, and a check valve 420, which is inserted into the pump coupling part 410 in order to prevent backflow of the wash water from the first drain hose 173*a*.

Here, the pump coupling part 410 may be formed in a hollow cylindrical shape. One end of the pump coupling part 410 may have an inner diameter corresponding to the outer diameter of the first drain hose 173*a*, and the other end thereof may have an inner diameter corresponding to the outer diameter of the first drain hose connector 219*a*.

In addition, the check valve 420 may be inserted into and fixed in the center portion of the pump coupling part 410 (i.e. the position between the first drain hose 173*a* and the first drain hose connector 219*a*). Here, the check valve 420 prevents the wash water remaining in the first drain hose 173*a* from moving toward the first drain hose connector 219*a*.

Meanwhile, the check valve 420 includes a ring-shaped valve body 412, which has an outer diameter corresponding to the inner diameter of the center portion of the pump coupling part 410 and is press-fitted into or adhered to the center portion of the pump coupling part 410, and a flip 414, which is rotatably coupled to the inside of the valve body 412 and blocks the space in the valve body 412.

When the drain pump 220 of the pump 200 described above drains the wash water to the first drain hose connector 219*a*, the check valve 420 is opened by the positive pressure generated by the drain impeller of the drain pump 220, whereby the wash water in the drain chamber 219 is drained to the first drain hose 173*a* through the first drain hose connector 219*a*.

In addition, when the drain pump 220 of the pump 200 drains the wash water to the second drain hose connector 219*b*, a positive pressure is applied to the second drain hose connector 219*b* by the impeller of the drain pump 220, whereby the wash water in the drain chamber is drained to the second drain hose 173*b* through the second drain hose connector 219*b*.

Here, a negative pressure is generated in the first drain hose connector 219*a*, and accordingly, the flip 414 of the check valve 420 is rotated toward the first drain hose connector 219*a*, thereby closing the valve body 412. Accordingly, the wash water remaining in the first drain hose 173*a* may be prevented from moving toward the first drain hose connector 219*a*.

In addition, the check valve 420 is formed such that the flip 414 is maintained in the state of closing the valve body 412 when a positive pressure is not generated in the first drain hose connector 219*a*. Since the flip 414 closes the valve body 412, it is possible to prevent odors generated in the first drain hose 173*a* or a drain, to which the first drain hose 173*a* is connected, from reaching the pump 200.

In each of the embodiments of the present disclosure described above, in which the first drain hose 173*a* or the second drain hose 173*b* is provided, it may be possible to prevent the wash water flowing through the drain hoses 173*a* and 173*b* from remaining on the surfaces of the drain hoses 173*a* and 173*b* by improving the shape of the inner surfaces of the drain hoses 173*a* and 173*b*.

Hereinafter, each of the drain hoses 173*a* and 173*b* according to an embodiment of the present disclosure will be described in detail with reference to the accompanying drawings. The following description should be understood with reference to the configuration and the description of the pump according to the above-described embodiment.

FIG. 11 is an exemplary view showing the surface of the drain hose according to still another embodiment of the present disclosure.

As shown, the inner surface of each of the drain hoses 173*a* and 173*b* may be formed to have a riblet shape in order to increase the fluidity of wash water. The riblet shape is a shape obtained by forming grooves in the surface of the drain hose in the direction of movement of the wash water in order to obtain a riblet phenomenon. The riblet phenomenon is a phenomenon of reducing drag force acting on an object by changing the flow structure of the surface using riblets. Accordingly, the wash water may smoothly move through the drain hose.

The riblet shape may be formed in various patterns. As shown in FIG. 11(*a*), a plurality of fine slits may be formed in the inner surface of each of the drain hoses 173*a* and 173*b* so as to extend in a direction parallel to the direction of movement of the wash water. Alternatively, as shown in FIG. 11(*b*), a plurality of fine recesses, into which the molecules of the wash water are not capable of permeating, may be formed in the inner surface of each of the drain hoses 173*a* and 173*b*.

This riblet shape may reduce the kinematic viscosity and the coefficient of surface friction between the molecules of the wash water and the inner surface of each of the drain hoses 173*a* and 173*b*, thereby reducing resistance to flow of the wash water. Accordingly, the wash water may smoothly flow through each of the drain hoses, and thus the amount of wash water remaining in each of the drain hoses may be reduced.

According to the embodiments of the present disclosure described above, it is possible to minimize the amount of wash water remaining in a pump for draining wash water outside the washing machine by improving the flow path of the pump.

In addition, according to the embodiments of the present disclosure, it is possible to prevent the generation of odors in a pump by minimizing the amount of wash water remaining in the pump.

In addition, according to the embodiments of the present disclosure, it is possible to prevent malfunction of a pump by minimizing the amount of wash water remaining in the pump.

While the present disclosure has been particularly shown and described with reference to exemplary embodiments thereof, it will be understood by those skilled in the art that various changes in form and details may be made therein without departing from the spirit and scope of the disclosure as defined by the appended claims. The exemplary embodiments should be considered in descriptive sense only and not for purposes of limitation. Therefore, the scope of the disclosure is defined not by the detailed description of the disclosure but by the appended claims, and all differences within the scope will be construed as being included in the present disclosure.

The invention claimed is:

1. A washing machine comprising:

a tub configured to store wash water therein;

a drum rotatably provided in the tub; and a pump provided at the tub and configured to drain and circulate the wash water, wherein the pump comprises:

a pump housing configured to receive the wash water flowing out of the tub, a drain chamber defined in one side of the pump housing, a drain pump mounted in the drain chamber, the drain pump being provided with a drain impeller configured to generate a drain pressure in the drain chamber, a first drain hose connector disposed at an upper portion of the drain chamber in a direction parallel to a horizontal direction and configured to discharge the wash water stored in the tub in response to rotation of the drain impeller in one direction, a second drain hose connector disposed at a lower portion of the drain chamber in a direction parallel to the horizontal direction and configured to discharge residual water present in the drain chamber in response to rotation of the drain impeller in an opposite direction, a first drain hose connected to the first drain hose connector, and a second drain hose connected to the second drain hose connector.

2. The washing machine of claim 1, wherein the first drain hose connector has a larger diameter than the second drain hose connector.

3. The washing machine of claim 1, wherein the second drain hose connector is formed adjacent to a lower end portion of the drain chamber.

4. The washing machine of claim 1, further comprising:

a drain hose coupler unit that connects an end portion of the first drain hose to an end portion of the first drain hose connector and that connects an end portion of the second drain hose to an end portion of the second drain hose connector.

5. The washing machine of claim 4, wherein the first drain hose, the second drain hose, and the drain hose coupler unit are integrally formed with each other.

6. The washing machine of claim 4, wherein the drain hose coupler unit comprises:

a first drain hose coupler configured to allow the first drain hose and the first drain hose connector to be coupled thereto;

a second drain hose coupler configured to allow the second drain hose and the second drain hose connector to be coupled thereto; and a connection rib configured to interconnect the first drain hose coupler and the second drain hose coupler.

7. The washing machine of claim 6, wherein the first drain hose connector is formed to be longer than the second drain hose connector.

8. The washing machine of claim 7, wherein the first drain hose coupler is first coupled to the first drain hose connector, and thereafter, the second drain hose coupler is coupled to the second drain hose connector.

9. The washing machine of claim 1, further comprising:

a backflow prevention unit provided between the first drain hose connector and the first drain hose to prevent backflow of wash water remaining in the first drain hose.

10. The washing machine of claim 9, wherein the first drain hose and the first drain hose connector are coupled to a pump coupling part, and wherein the backflow prevention unit is located between the first drain hose and the first drain hose connector inside the pump coupling part.

11. The washing machine of claim 10, wherein the backflow prevention unit is a check valve configured to prevent backflow of the wash water remaining in the first drain hose.

12. The washing machine of claim 1, further comprising:

a circulation hose configured to circulate the wash water in the tub; and a circulation nozzle configured to spray the wash water into the drum.

13. The washing machine of claim 12, wherein the pump further comprises:

a circulation chamber formed in an opposite side of the pump housing;

a circulation hose connector formed at an upper portion of the circulation chamber, the circulation hose connector being configured to allow the circulation nozzle to be connected thereto; and a circulation pump mounted in the circulation chamber, the circulation pump being provided with a circulation impeller configured to generate a circulation pressure in the circulation chamber.

14. The washing machine of claim 1, wherein the pump housing has a filter insertion hole formed therein so as to be open toward a front side of the washing machine to allow a filter to be detachably inserted thereinto.

15. The washing machine of claim 14, further comprising:

a filter door mounted to a front surface of the washing machine at a position corresponding to a position of the filter insertion hole to enable mounting and demounting of the filter.

16. The washing machine of claim 1, wherein the first drain hose and the second drain hose extend to an outside of the washing machine, and wherein end portions of the first drain hose and the second drain hose converge using a converging member.

17. The washing machine of claim 1, wherein the first drain hose or the second drain hose has an inner surface formed to have a riblet pattern.

18. The washing machine of claim 17, wherein the riblet pattern has a shape of a slit formed parallel to a direction of movement of wash water moving through the first drain hose or the second drain hose.

19. The washing machine of claim 17, wherein the riblet pattern has a shape of a fine recess having a size preventing molecules of wash water moving through the first drain hose or the second drain hose from permeating thereinto.

* * * * *